US006296554B1

(12) United States Patent
Lai et al.

(10) Patent No.: US 6,296,554 B1
(45) Date of Patent: Oct. 2, 2001

(54) NON-CIRCULAR WORKPIECE CARRIER

(75) Inventors: Kuo-Chih Lai; Chang-Ku Hung, both of Hsinchu (TW)

(73) Assignees: Industrial Technology Research Institute; Kinik Precision Grinding Co., both of Hsinchu (TW)

( * ) Notice: Subject to any disclaimer, the term of this patent is extended or adjusted under 35 U.S.C. 154(b) by 0 days.

(21) Appl. No.: 09/458,083

(22) Filed: Dec. 10, 1999

(30) Foreign Application Priority Data

Oct. 22, 1999 (TW) ..... 088217975

(51) Int. Cl.[7] ..... B24B 5/00

(52) U.S. Cl. ..... 451/271; 451/288; 451/291; 451/400

(58) Field of Search ..... 451/271, 288, 451/291, 400

(56) References Cited

U.S. PATENT DOCUMENTS 4,916,868 * 4/1990 Wittstock ..... 451/271
4,996,798 * 3/1991 Moore ..... 451/400
5,085,009 * 2/1992 Kinumura et al. ..... 451/291
5,140,774 * 8/1992 Onodera ..... 451/291
6,080,042 * 6/2000 McGregor et al. ..... 451/291
6,135,854 * 10/2000 Masumura et al. ..... 451/291

FOREIGN PATENT DOCUMENTS 47-27315 * 7/1972 (JP) ..... 451/291
401092063 * 4/1989 (JP) ..... 451/288

* cited by examiner

*Primary Examiner*—M. Rachuba
(74) *Attorney, Agent, or Firm*—Rabin & Berdo, P.C.

(57) ABSTRACT

A non-circular workpiece carrier, which includes a wheel-like carrier body, and at least one carriage, wherein the wheel-like carrier body has a transmission unit disposed around the periphery thereof, which receives a transmission power for causing the wheel-like carrier body to turn round, and at least one carrier unit; the at least one carriage is respectively disposed in the at least one carrier unit to hold non-circular workpiece, and forced to gyrate in the at least one carrier unit relative to the wheel-like carrier body, enabling loaded non-circular workpiece to be surface-processed (ground, polished, etc.) more evenly. Different carriages are alternatively used with the carrier body subject to the shapes of workpiece to be processed.

17 Claims, 6 Drawing Sheets

NON-CIRCULAR WORKPIECE CARRIER

BACKGROUND OF THE INVENTION

The present invention relates to a workpiece carrier, and more particularly to a non-circular workpiece carrier for carrying a non-circular workpiece in a processing machine for receiving a processing process, for example, grinding, polishing, etc.

In a processing machine 9 for processing wafer, ceramic substrate, silicon substrate, back light board, glass board, etc., a center gear 92 and an external gear 91 are concentrically mounted on the machine base 90, a plurality of workpiece carriers 93 are meshed between the center gear 92 and the external gear 91 and work as planet gears. When the top abrasive wheel 94 and a bottom abrasive wheel 95 are closed on top and bottom sides of the workpiece carriers 93, the processing machine 9 is started, thereby causing the top and bottom walls of the workpiece to be ground and polished. The workpiece carrier 93, as shown in FIG. 2, comprises a plurality of non-circular holes 931 for receiving a respective non-circular workpiece 31' for processing. The holes 931 fit the non-circular shape of the workpiece 31' to be processed. Because the non-circular workpiece 31' cannot be rotated relative to the workpiece carrier 93 when the workpiece carrier 93 is rotated and turned about the center gear 92, different locations at the surface of the non-circular workpiece receive different cutting speed, thereby preventing the surface of the workpiece from being evenly processed. Further, the workpiece carriers 93 can be used for carrying a particular shape of workpiece only. For processing workpieces of different shapes, different workpiece carriers shall be used.

SUMMARY OF THE INVENTION

It is one object of the present invention to provide a non-circular workpiece carrier, which enables the surface of the loaded workpiece to be processed more evenly. It is another object of the present invention to provide a non-circular workpiece carrier, which uses replaceable carriages with a common carrier body, so that different carriages can be used to carry different workpiece. According to the present invention, the non-circular workpiece carrier comprises a wheel-like carrier body, and at least one carriage. The wheel-like carrier body comprises a transmission unit disposed around the periphery thereof, and at least one carrier unit. The transmission unit receives a transmission power for causing the wheel-like carrier body to rotate around the machine base. The at least one carriage is respectively disposed in the at least one carrier unit to hold non-circular workpiece, and forced to gyrate relative to the wheel-like carrier body, enabling loaded non-circular workpiece to be surface-processed (ground, polished, etc.) evenly. Each carriage has at least one positioning unit for the position of a respective non-circular workpiece. Different carriages are alternatively used with the carrier body subject to the shapes of workpiece to be processed. In one embodiment of the present invention, the carrier unit is a circular through hole, and the carriage is comprised of a disk-like base fitting the circular through hole. In another embodiment of the present invention, the carrier unit is a circular recess, and the carriage is a bracket fitting the circular recess. The positioning unit can be a non-circular through hole or recess fitting the shape of the workpiece. For example, the positioning unit can have a square shape, triangular shape, hexagonal shape, rhombic shape, or any of a variety of irregular shapes such as heart shape, S-shape, etc. The transmission unit of the carrier body can be driven by chain means, rack means, belt, friction wheel, electric power, magnetic force, etc.

DETAILED DESCRIPTION OF THE PREFERRED EMBODIMENT

Figure 3:
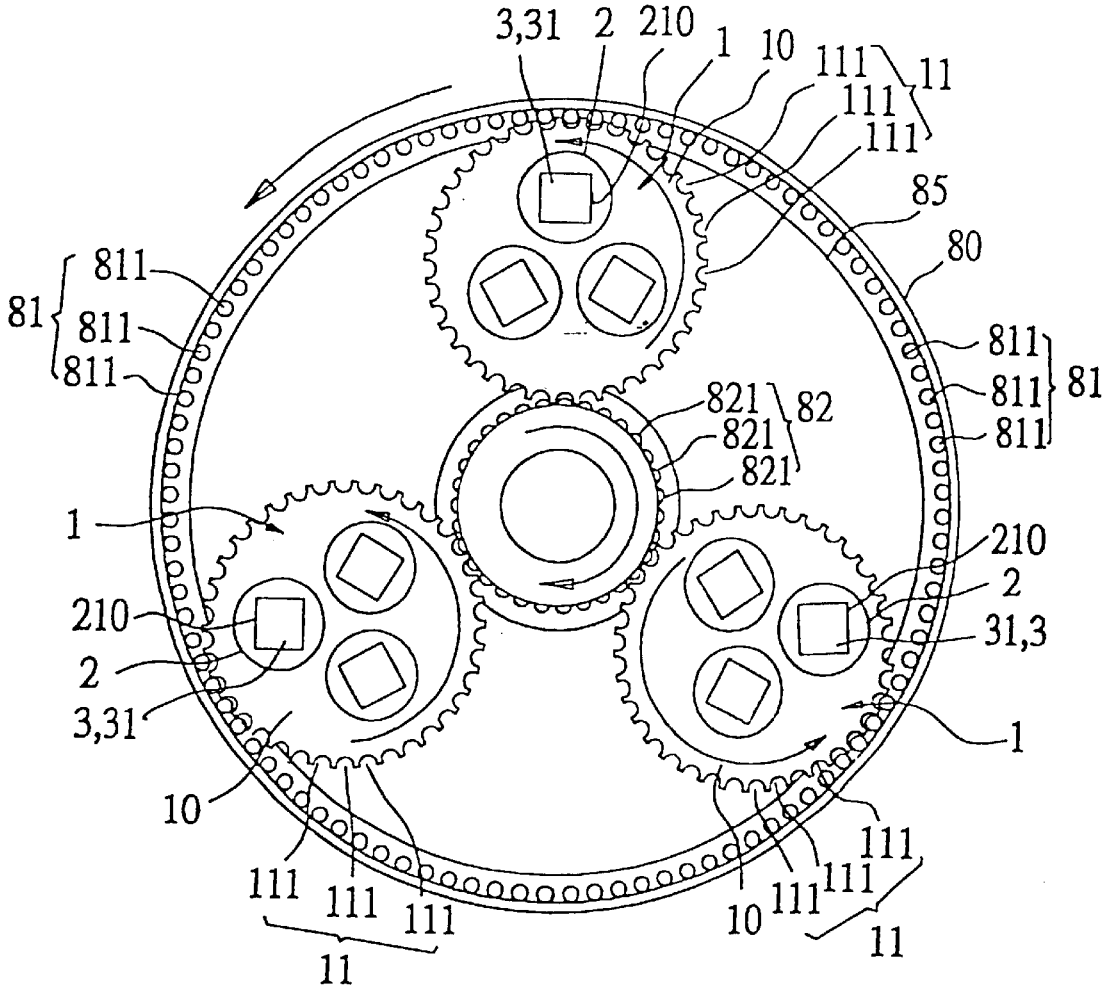
FIG. 3 is a top view showing workpiece carriers installed in a machine base and meshed between an external gear and a center gear according to the present invention.

FIG. 3 shows one embodiment of the non-circular workpiece carrier for carrying non-circular workpiece 3, for example, square workpiece 31. An external gear 81 and a center gear 82 are concentrically mounted on a machine base 80. A top abrasive wheel (not shown) and a bottom abrasive wheel 85 are disposed at top and bottom sides of the gears 81 and 82 for grinding the top and bottom sides of the square workpiece 31. The gears 81 and 82 are respectively formed of multiple vertical cylinders 811 or 821 arranged into a circle. Three workpiece carriers 1 are equiangularly meshed between the center gear 82 and the external gear 81, and kept in balance. The workpiece carriers 1 each are comprised of a wheel-like carrier body 10 having a transmission unit 11 around the periphery. The transmission unit 11 is formed of a plurality of teeth 111, i.e., smoothly arched peripheral notches are made on the periphery of the wheel-like carrier body 10 defining a plurality of equiangularly spaced teeth 111. By means of the respective teeth 111, the workpiece carriers 1 are meshed between the center gear 82 and the external gear 81. When the external gear 81 and/or the center gear 82 are rotated relatively, the workpiece carriers 1 work as planet gear wheels, and are rotated on the machine base 80.

Figure 4:
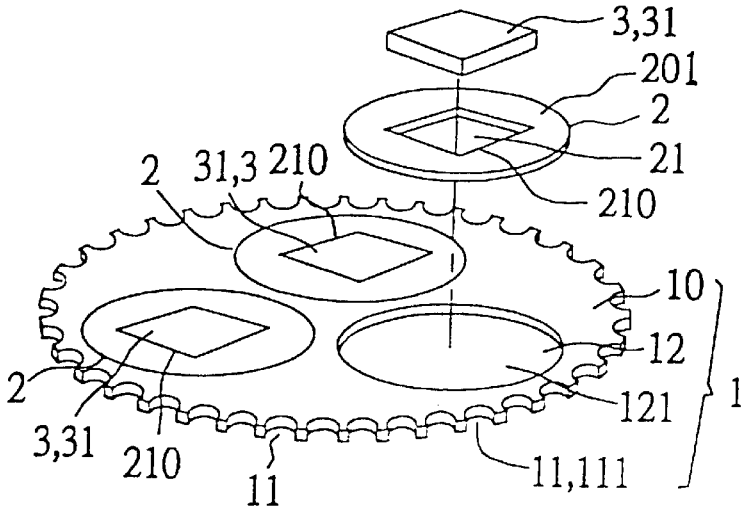
FIG. 4 is an exploded view of a non-circular workpiece carrier according to the present invention.

Referring to FIG. 4, the wheel-like carrier body 10 of the workpiece carrier 1 comprises three evenly distributed carrier means 12, and three carriages 2. According to the present embodiment, the carrier means 12 each are comprised of a circular through hole 121. The carriages 2 are respectively mounted in the circular through holes 121 of the carrier units 12. The carriages 2 each are comprised of a disk-like base 201 having a diameter slightly smaller than the circular through holes 121 on the wheel-like carrier body 10 of the workpiece carrier 1. Therefore, the disk-like base 201 of each carriage 2 can be respectively received in the circular through holes 121 on the wheel-like carrier body 10, and rotated relative to the carrier body 10 of the workpiece carrier 1. Each carriage 2 further comprises a positioning means 21, for example, a square through hole 210 on the disk-like base 201. The size of the square through hole 210 is slightly greater than the square workpiece 31, so that the square workpiece 31 can be set in the square through hole 210.

When every carrier 1 is moved on the machine base 80 as a planet gear wheel, the carriages 2 gyrate; therefore the surface of each square workpiece 31 (non-circular workpiece 3) is ground more evenly.

Figure 1:
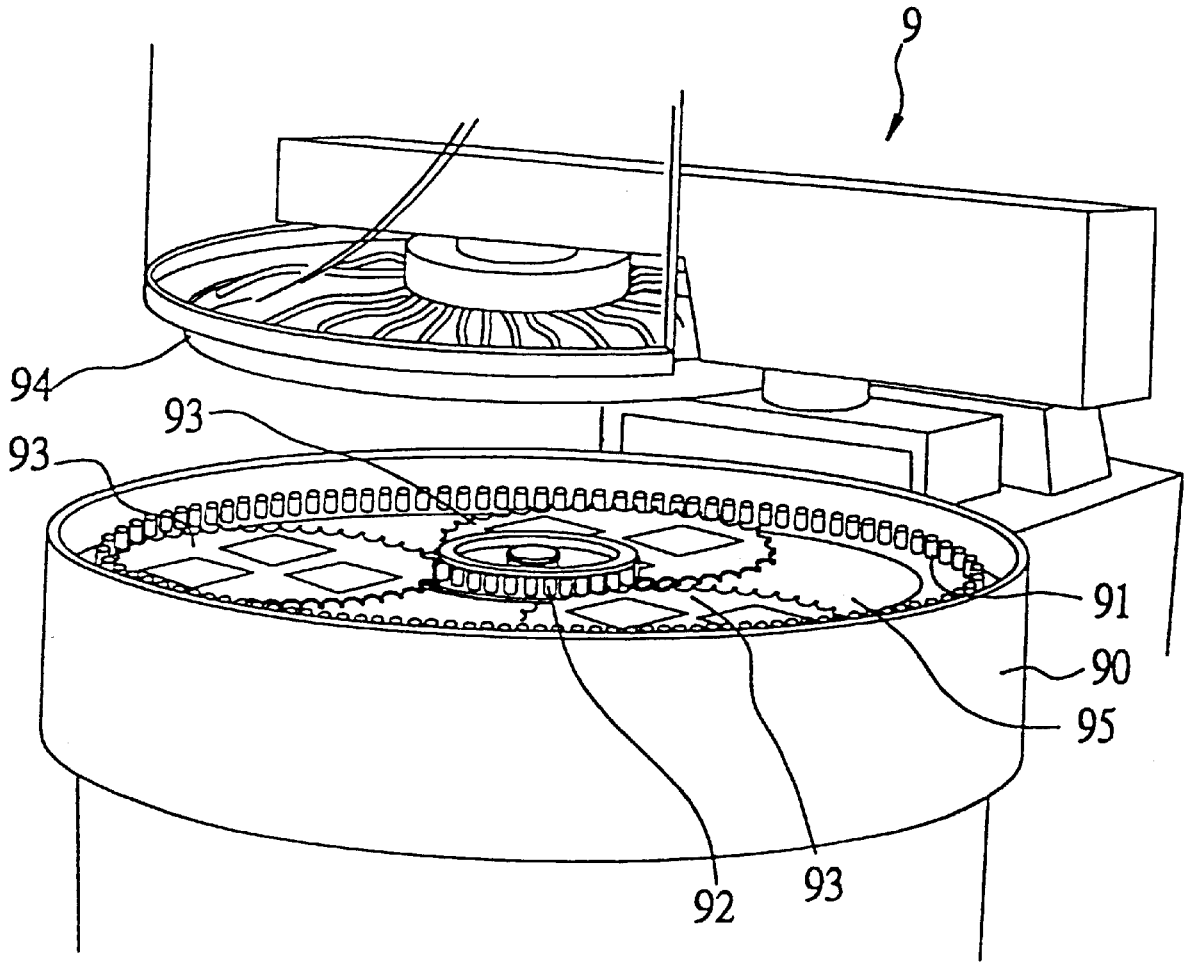
Fig. 1 (PRIOR ART)
FIG. 1 is a perspective assembly view of a grinding/polishing machine according to the prior art.
Figure 2:
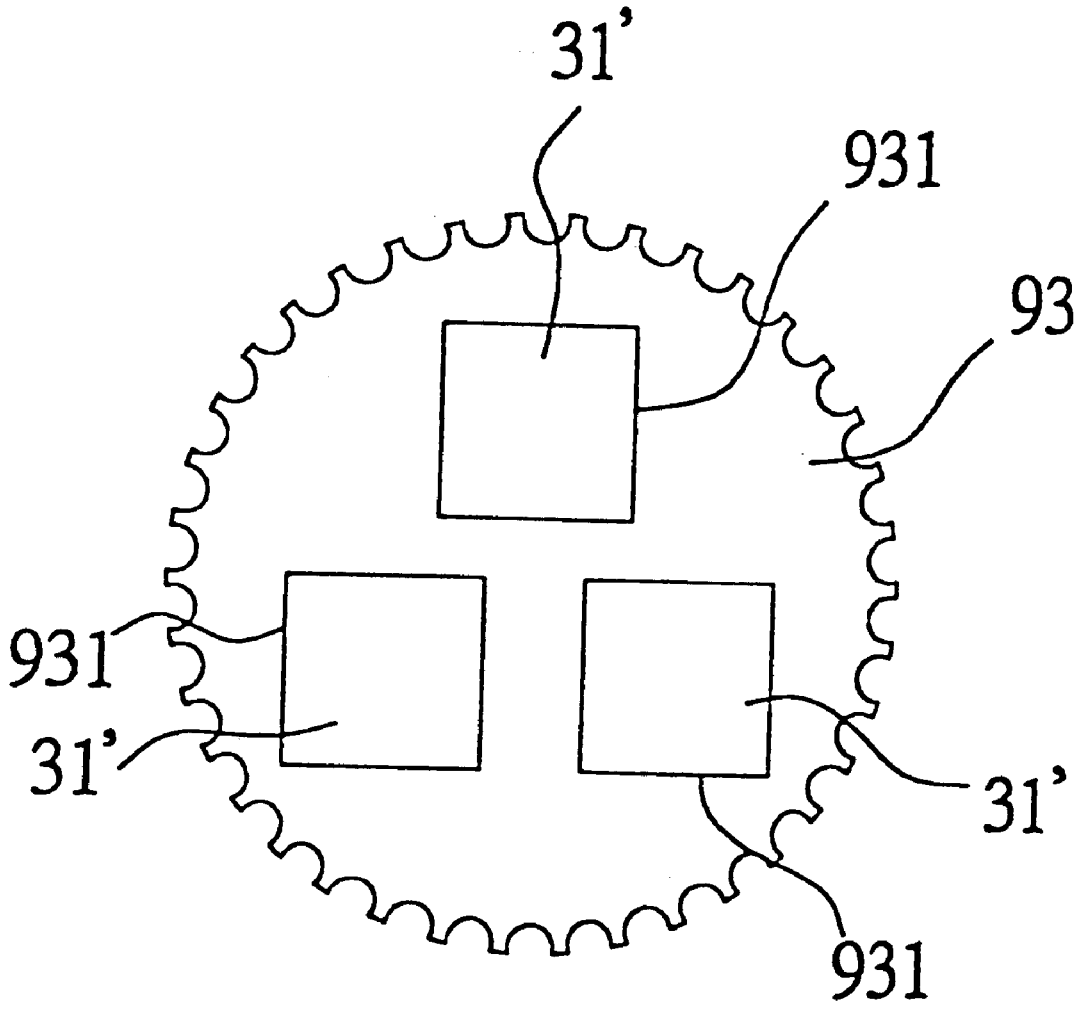
Fig. 2 (PRIOR ART)
FIG. 2 is a top view of a non-circular workpiece carrier according to the prior art.
Figure 5:
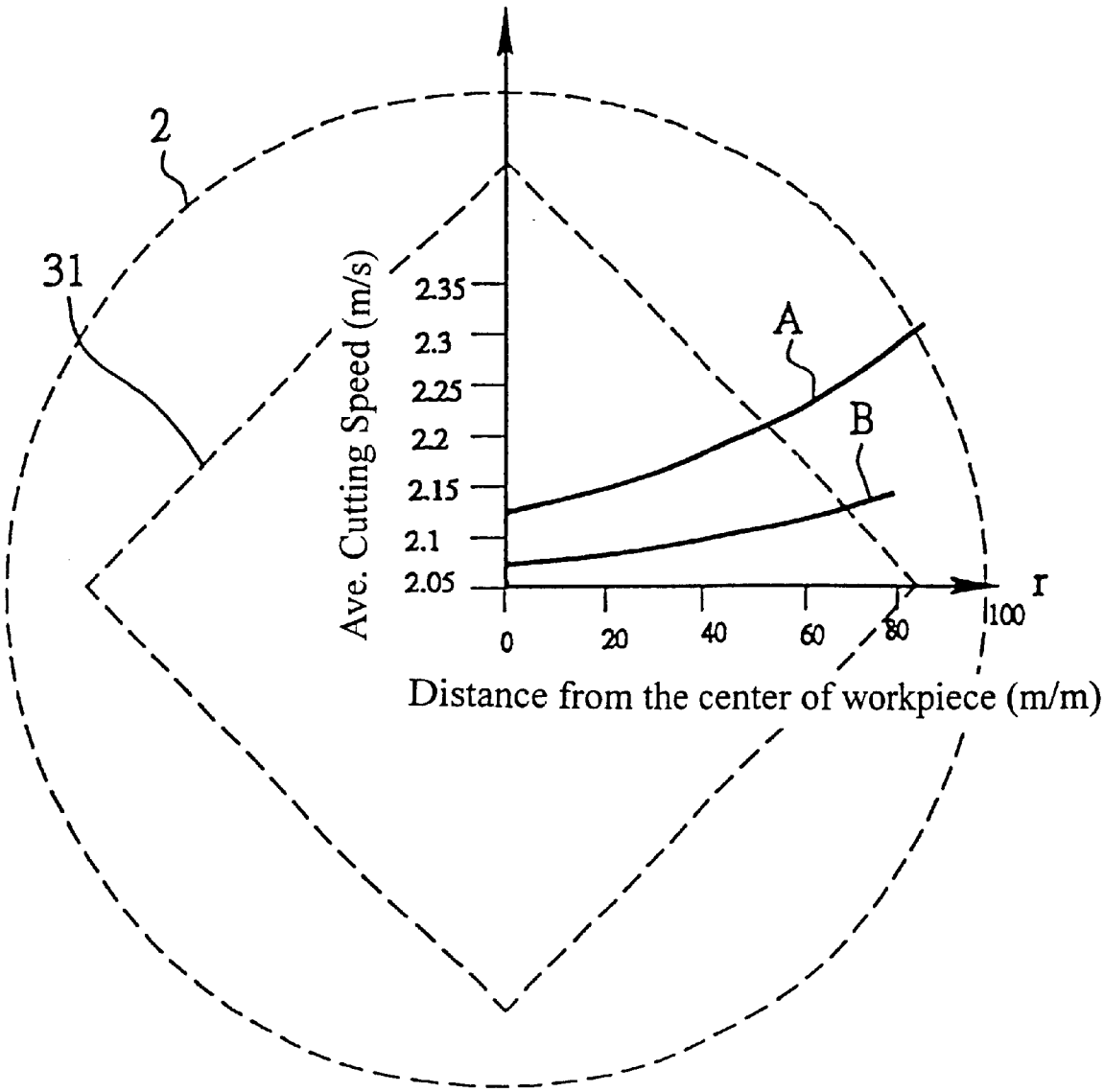
FIG. 5 is a cutting speed distribution comparison chart according to the present invention and the prior art.
Figure 6:
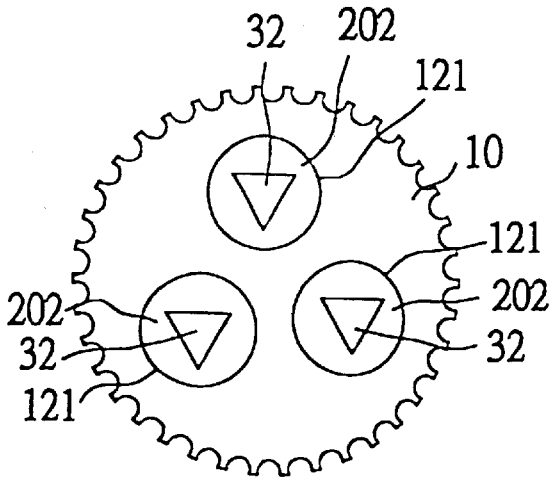
FIG. 6 is a top view of an alternate form of the present invention.
Figure 7:
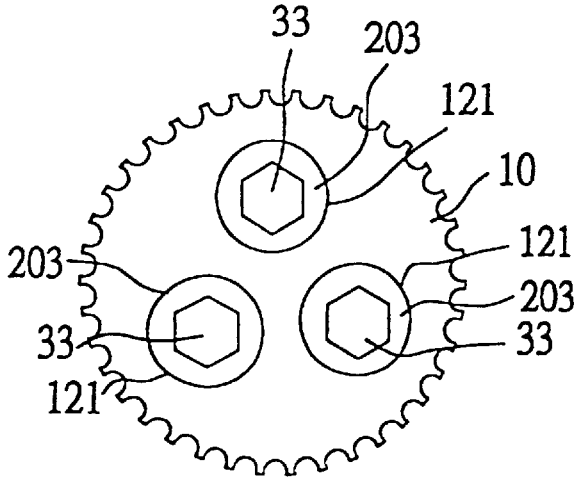
FIG. 7 is a top view of another alternate form of the present invention.
Figure 8:
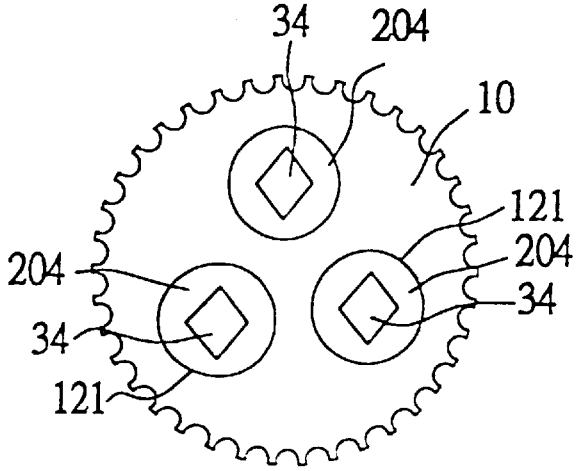
FIG. 8 is a top view of still another alternate form of the present invention.

FIG. 5 illustrates test results subject to the following data:

| Prior art (FIG. 2) | The invention (FIG. 4) |
|---|---|
| Diameter of External gear 1400 mm | Diameter of External gear 1400 mm |
| Diameter of carrier 570 mm | Diameter of carrier 570 mm |
| | Diameter of carriage 200 mm |
| Square workpiece | Square workpiece |
| Result: Curve A | Result: Curve B |

As indicated above, according to Curve A obtained from the square workpiece 31' on the prior art carrier 93, the slope of the cutting speed is relatively steeper, i.e., there is a great difference in cutting speed between the center (r=0) of the workpiece and its periphery (r=90 mm). On the contrary, Curve B obtained from the square workpiece 31 on the carriage 2 in the carrier 1 of the present invention is less steep; the difference in cutting speed between the center of the workpiece and its periphery is greatly reduced. Therefore, the invention greatly improves the evenness in processing.

Referring to FIGS. from 6 through 8, when processing workpiece of different shapes (triangular workpiece 32, hexagonal workpiece 33, rhombic workpiece 34), different disk-like bases 202, 203, or 204 are used without changing carrier body 10 of the workpiece carrier 1. In addition to the planet motion type processing machines, the invention can also be applied to other kinds of machines.

Figure 9:
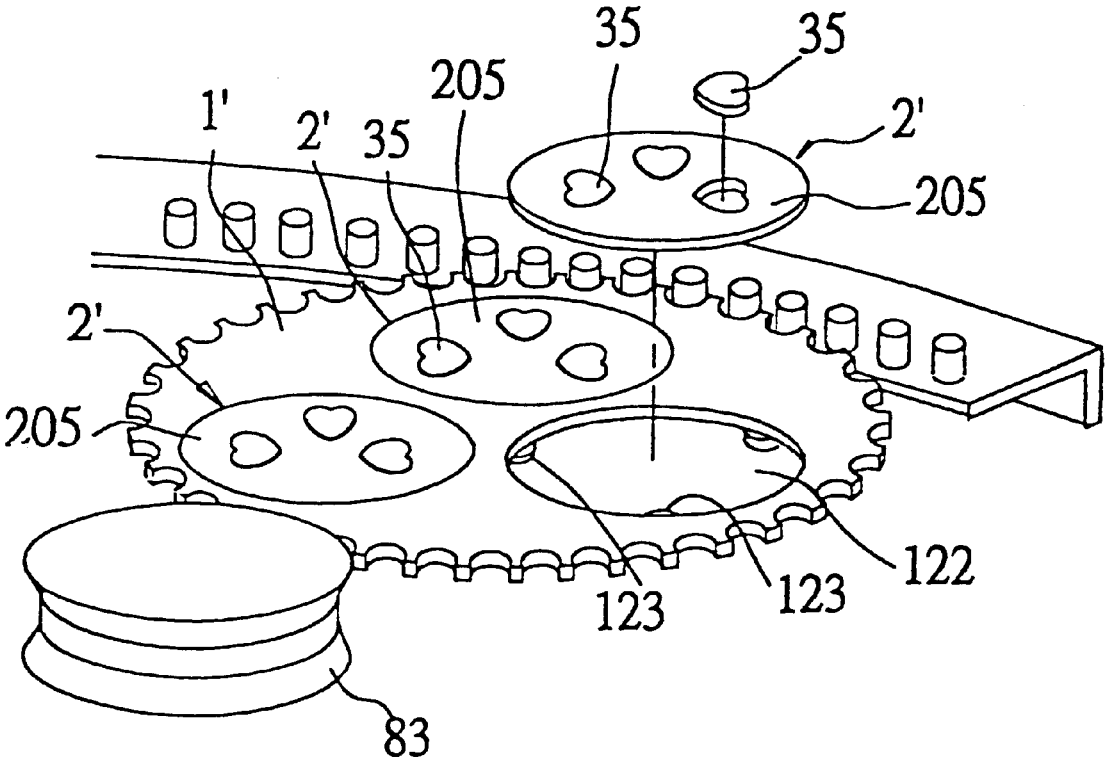
FIG. 9 is a perspective view of still another alternate form of the present invention.

FIG. 9 shows still another alternate form of the present invention. According to this embodiment, the carrier 1' comprises three circular recesses 122, and a plurality of rollers 123 equiangularly disposed in the border area of each circular recess 122 to support respective carriages 2' in the circular recesses 122. The carriages 2' each are comprised of a circular bracket 205 for carrying three heart-shaped workpiece 35. Furthermore, a friction wheel 83 is used in this embodiment to substitute for the aforesaid center gear 82.

It is to be understood that the drawings are designed for purposes of illustration only, and are not intended for use as a definition of the limits and scope of the invention disclosed.

What the invention claimed is:

1. A non-circular workpiece carrier for carrying non-circular workpieces and receiving a transmission power, comprising:

a wheel-like carrier body, said wheel-like carrier body comprising a transmission unit disposed around the outer periphery thereof for receiving a transmission power for causing said wheel-like carrier body to turn round, and at least one circular carrier means for receiving a circular carriage; and at least one circular carriage respectively disposed in said at least one carrier means and being constantly free to gyrate in said at least one carrier means relative to said wheel-like carrier body, said at least one carriage comprising at least one positioning means for the positioning of a respective non-circular workpiece.

2. The non-circular workpiece carrier of claim 1, wherein said at least one carrier means of said wheel-like carrier body is comprised of a circular through hole, and said at least one carriage is comprised of a disk-like base respectively disposed in the circular through hole, said disk-like base having a diameter smaller than said circular through hole.

3. The non-circular workpiece carrier of claim 1, wherein said at least one carrier means of said wheel-like carrier body is comprised of a circular recess, and said at least one carriage each is comprised of a circular bracket respectively received in the circular recess, said circular bracket having a diameter smaller than said circular recess.

4. The non-circular workpiece carrier of claim 1, wherein said at least one positioning means of said at least one carriage is comprised of a through hole of a shape fitting the workpiece to be carried, said through hole having a cross section greater than the cross section of the workpiece to be carried.

5. The non-circular workpiece carrier of claim 1, wherein said at least one positioning means of said at least one carriage is comprised of a square through hole for the positioning of a square workpiece.

6. The non-circular workpiece carrier of claim 1, wherein said at least one positioning means of said at least one carriage is comprised of a triangular through hole for the positioning of a triangular workpiece.

7. The non-circular workpiece carrier of claim 1, wherein said at least one positioning means of said at least one carriage is comprised of a hexagonal through hole for the positioning of a hexagonal workpiece.

8. The non-circular workpiece carrier of claim 1, wherein said at least one positioning means of said at least one carriage is comprised of a rhombic through hole for the positioning of a rhombic workpiece.

9. The non-circular workpiece carrier of claim 1, wherein said at least one positioning means of said at least one carriage is comprised of a non-circular through hole for the positioning of a non-circular workpiece.

10. The non-circular workpiece carrier of claim 1, wherein said transmission unit of said wheel-like carrier body is comprised of a plurality of teeth equiangularly disposed around the outer periphery of said wheel-like carrier body.

11. The non-circular workpiece carrier of claim 10, wherein said teeth are defined by a plurality of smoothly arched peripheral notches at the periphery of said wheel-like carrier body.

12. The non-circular workpiece carrier of claim 1, wherein said carrier means comprises at least three holes, each receiving a respective carriage therein.

13. The non-circular workpiece carrier of claim 1, wherein said carrier means comprises at least three recesses, each receiving a respective carriage therein.

14. A workpiece carrier, comprising:

a carrier body having a plurality of holes formed therein; and a plurality of circular carriages, each carriage being disposed in a respective hole, and each having a diameter that is less than a diameter of the respective hole so that each carriage is free to rotate in the respective hole, each carriage further having a non-circular hole for receiving a non-circular work piece.

15. The workpiece carrier recited in claim 14, wherein the plurality of holes comprises three holes.

16. A workpiece carrier, comprising:

a carrier body having a plurality of recesses formed therein; and a plurality of circular brackets, each bracket being disposed in a respective recess, and each having a diameter that is less than a diameter of the respective recess so that each bracket is free to rotate in the respective recess, each bracket further having a non-circular hole for receiving a non-circular work piece.

17. The workpiece carrier recited in claim 16, wherein the plurality of recesses comprises three recesses.

* * * * *